US007707805B2

(12) United States Patent
Gorrieri

(10) Patent No.: US 7,707,805 B2
(45) Date of Patent: May 4, 2010

(54) METHOD AND MACHINE FOR PACKAGING GROUPS OF PRODUCTS ORDERED IN ONE OR MORE LAYERS

(75) Inventor: Giordano Gorrieri, Bologna (IT)

(73) Assignee: KPL Packàging S.p.A., Bologna (IT)

( * ) Notice: Subject to any disclaimer, the term of this patent is extended or adjusted under 35 U.S.C. 154(b) by 184 days.

(21) Appl. No.: 12/084,960

(22) PCT Filed: Nov. 14, 2006

(86) PCT No.: PCT/IT2006/000794

§ 371 (c)(1),
(2), (4) Date: May 14, 2008

(87) PCT Pub. No.: WO2007/057938

PCT Pub. Date: May 24, 2007

(65) Prior Publication Data

US 2009/0120045 A1 May 14, 2009

(30) Foreign Application Priority Data

Nov. 17, 2005 (IT) ..... BO2005A0698

(51) Int. Cl.
*B65B 11/26* (2006.01)
*B65B 11/16* (2006.01)
*B65B 25/14* (2006.01)

(52) U.S. Cl. ..... 53/463; 53/447; 53/466; 53/209; 53/230; 53/540

(58) Field of Classification Search ..... 53/447, 53/463, 466, 209, 228, 230, 231, 540; *B65B 11/16, B65B 11/26, 25/14*
See application file for complete search history.

(56) References Cited

U.S. PATENT DOCUMENTS

| | | | | |
|---|---|---|---|---|
| 1,851,295 | A * | 3/1932 | Schmitt | 53/230 |
| 2,153,483 | A * | 4/1939 | Rose | 53/231 |
| 2,620,964 | A * | 12/1952 | Rose et al. | 53/466 |
| 3,855,758 | A * | 12/1974 | Walter et al. | 53/230 |
| 4,313,290 | A * | 2/1982 | Furuya et al. | 53/230 |
| 6,766,625 | B2 * | 7/2004 | Cinotti | 53/230 |
| 2002/0059779 | A1 | 5/2002 | Gamberini | |
| 2002/0059785 | A1 | 5/2002 | Gamberini | |
| 2002/0116895 | A1 * | 8/2002 | Antoniazzi et al. | 53/230 |

(Continued)

FOREIGN PATENT DOCUMENTS

EP 1 258 337 A1 11/2002

(Continued)

*Primary Examiner*—Stephen F Gerrity
(74) *Attorney, Agent, or Firm*—Breiner & Breiner, L.L.C.

(57) ABSTRACT

A machine for packaging groups of products ordered in one or more layers, which includes a magazine for the supply of the group of products; apparatus for supplying a packaging sheet the sheet being set vertically to a front face of the product, a pusher for unloading the product; a first-folding spindle set downstream of the wrapping sheet; a pair of horizontal conveyors, set on top of one another, set downstream of the first-folding spindle; a vertical folder, which operates in the short space between the folding spindle and the pair of conveyors; and apparatus to superimpose on the bottom of the product the last transverse end flaps of the packaging sheet; and apparatus for fixing the bottom flaps.

12 Claims, 4 Drawing Sheets

U.S. PATENT DOCUMENTS

| | | | |
|---|---|---|---|
| 2005/0097865 | A1 | 5/2005 | Gamberini |
| 2005/0229538 | A1 | 10/2005 | Dall' Omo et al. |

FOREIGN PATENT DOCUMENTS

| | | | | |
|---|---|---|---|---|
| GB | 2023085 | A | * | 12/1979 |
| GB | 2160843 | A | * | 1/1986 |
| GB | 2 368 058 | A | | 4/2002 |
| JP | 02219710 | A | * | 9/1990 |

* cited by examiner

METHOD AND MACHINE FOR PACKAGING GROUPS OF PRODUCTS ORDERED IN ONE OR MORE LAYERS

The invention relates to a method and a machine for packaging groups of products ordered in one or more layers, for example rolls of paper for hand towels or kitchen wipes, or rolls of toilet paper, or other products that involve similar needs. In particular, the method and the machine referred to are proposed as alternatives that are easier to produce, with lower production costs, and with a faster operating cycle to a known method and to a known machine for packaging groups of products or products of prismatic shape with a rectangular or square base, which, from a feed or grouping magazine, are then displaced towards a first-folding spindle so as to exit therefrom wrapped, substantially in the form of a U rotated through 90° and open at the back, by a packaging sheet that is previously positioned in front of said spindle with vertical arrangement, said method and said machine being characterized in that the products with the packaging sheet that exit from said spindle, are directly picked up and fed in phase between the parallel and horizontal motor-driven conveyors of a tipping drum, within which are set, longitudinally, edge on and parallel to one another, side folders that guide the product laterally with the packaging and fold, on the side faces of the product itself, the first vertical-folding flaps, which project laterally and forwards with respect to the direction of advance of the packaging itself. The tipping drum is controlled in cyclic rotations of 180°, always in the same direction and always loaded with a partially packaged product. After each rotation of said unit about its own axis orthogonal to the direction of advance of the product, the conveyors of this same unit are reactivated for expulsion of the product with the packaging towards means that complete folding and fixing of the flaps of the same packaging sheet. In this same step, inserted between the conveyors of the tipping device is a new product with the corresponding packaging sheet directly unloaded from said first-folding spindle. The tipping drum is an apparatus of relatively complex construction and, also for problems of inertia linked to its own weight, involves cycle times that are not short. A first object of the invention is to provide an alternative to the known method and machine as mentioned at the outset, which will enable elimination of the use of said tipping drum.

The above and other objects are achieved with a method and a machine according to the annexed claims, the characteristics and advantages of which will appear clearly from the ensuing description of a preferred embodiment thereof, illustrated purely by way of non-limiting example in the figures of the attached four plates of drawings, in which:

Figure 1:
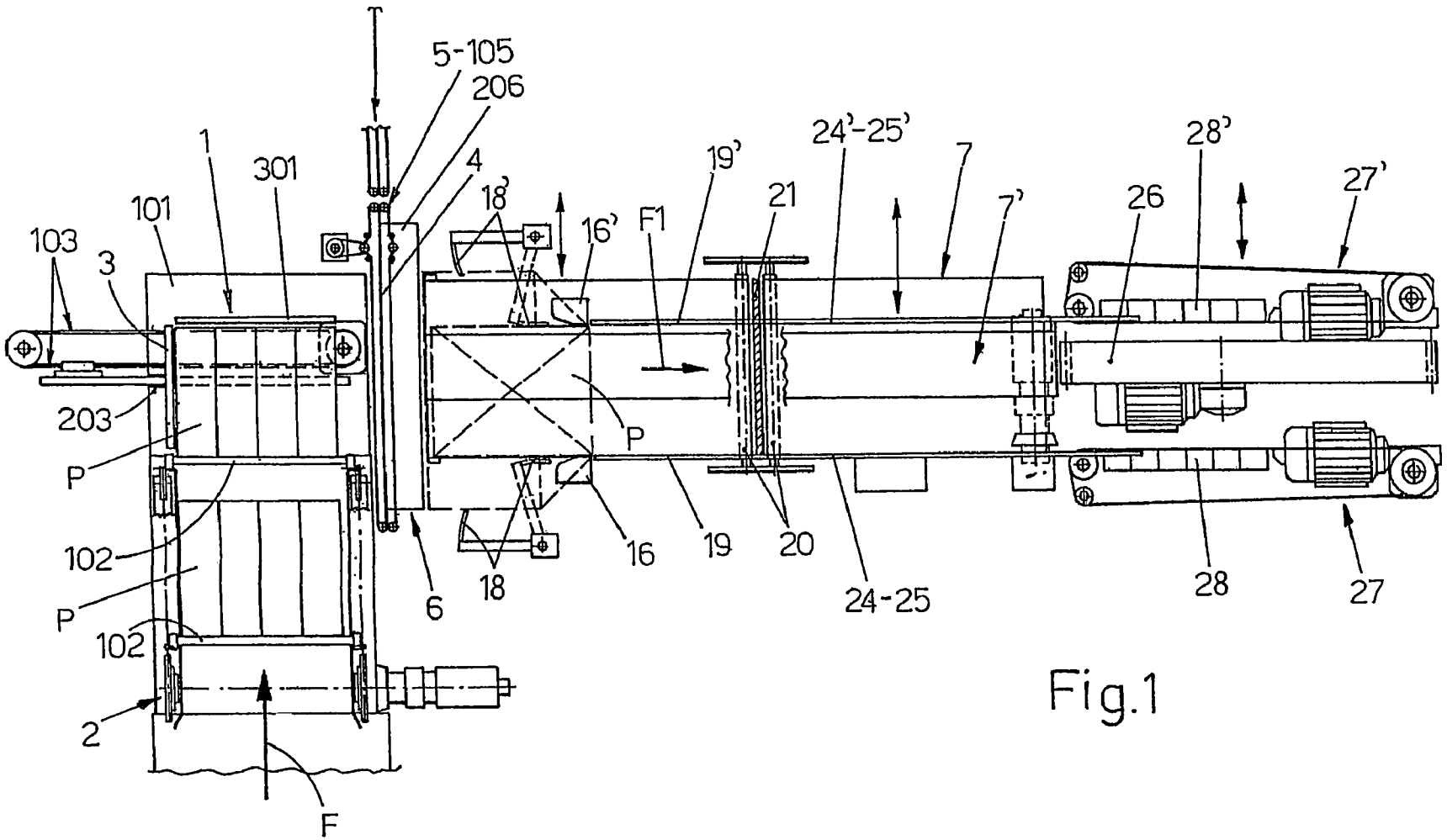
FIG. 1 is a schematic top plan view of the machine according to the invention.
Figure 2:
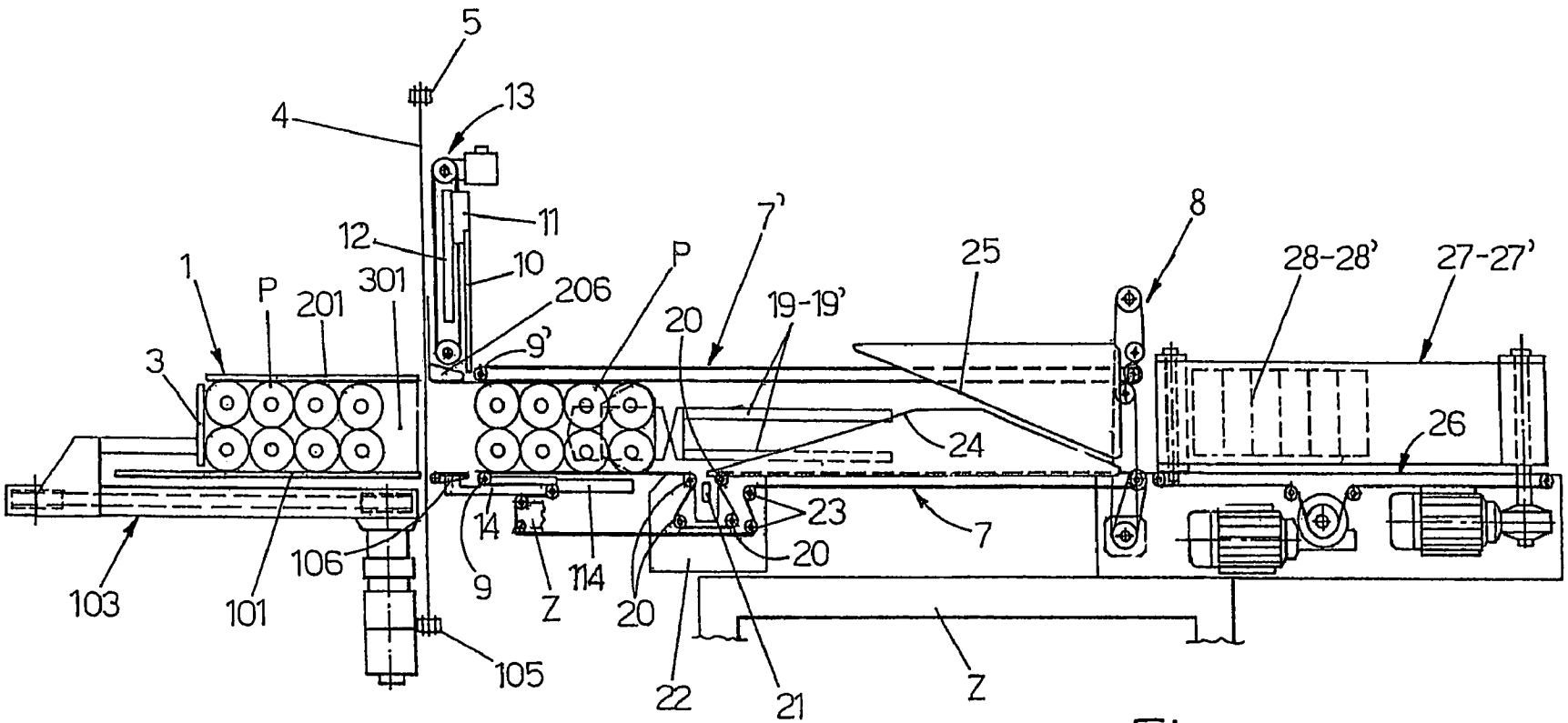
FIG. 2 illustrates the machine in side elevation and in some first working steps.
Figure 2A:
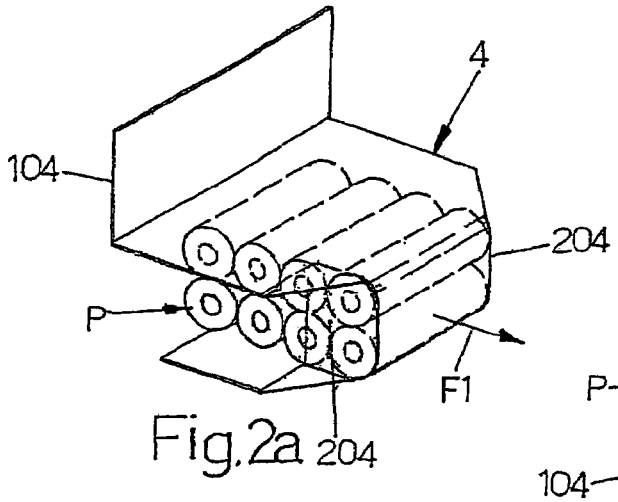
FIGS. 2*a*, 4*a*, 5*a*, 6*a*, 7 and 8 are perspective views of a group of products shown in subsequent steps of the cycle of packaging of the machine according to FIGS. 2 to 6 and in other working steps.
Figure 4A:
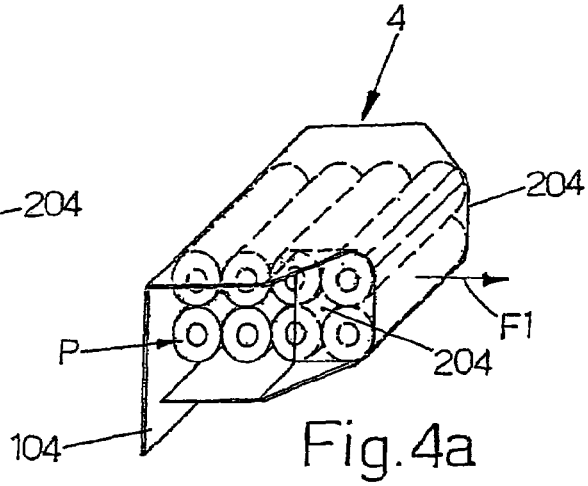
Figure 5A:
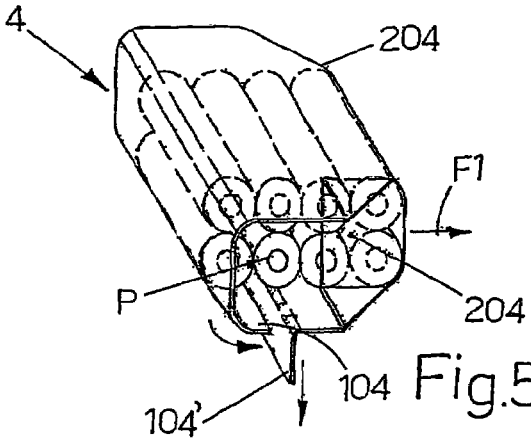
Figure 6A:
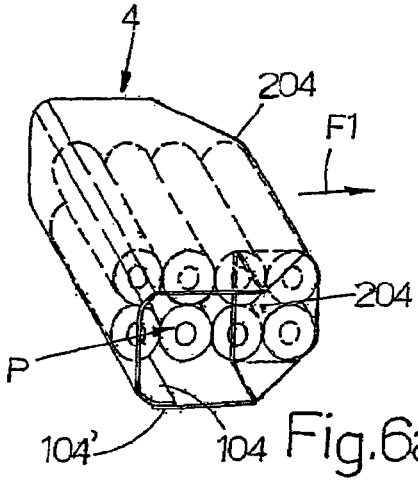
Figure 7:
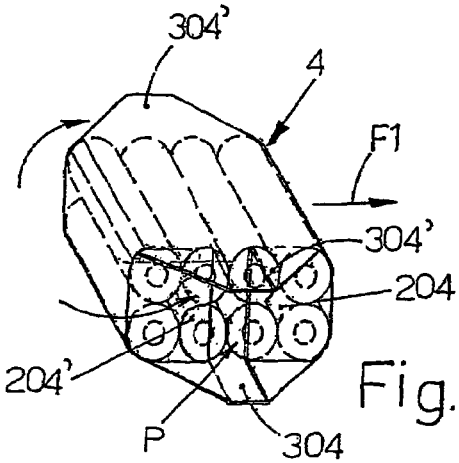
Figure 8:
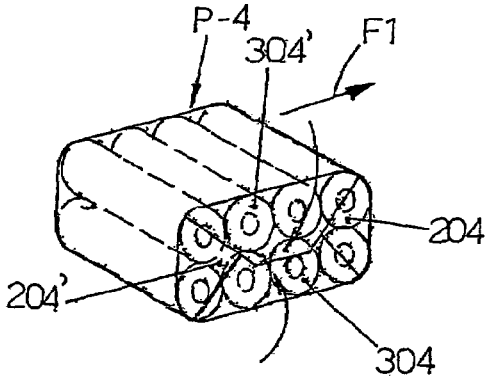
Figure 4:
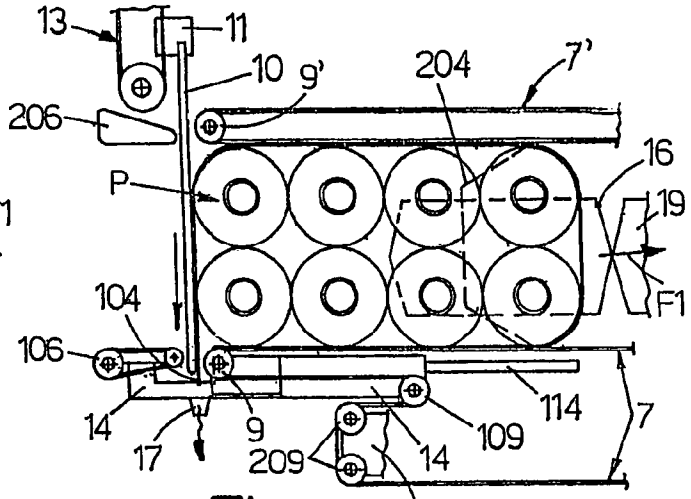
FIGS. 4, 5 and 6 are schematic views in side elevation, of the operating station set downstream of the first-folding spindle, shown in successive working steps.
Figure 3:
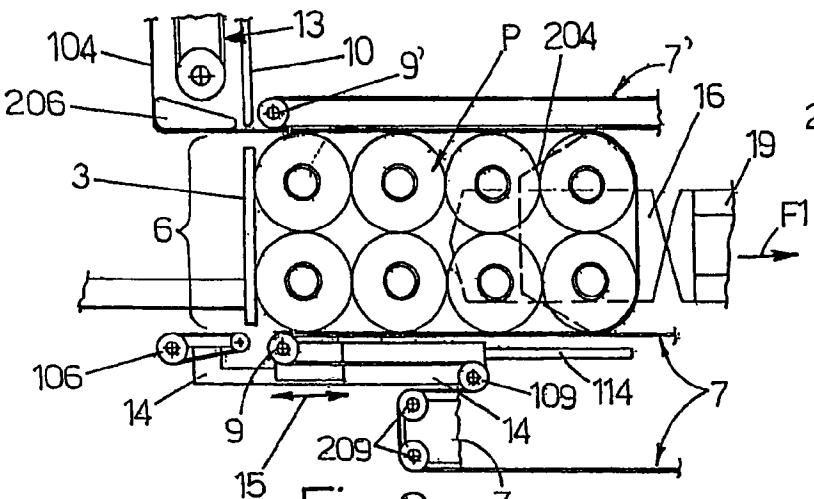
FIG. 3 illustrates, laterally and at an enlarged scale, the ensemble of the bottom conveyors of the station set downstream of the first-folding spindle, shown in the same condition of FIG. 2.
Figure 6:
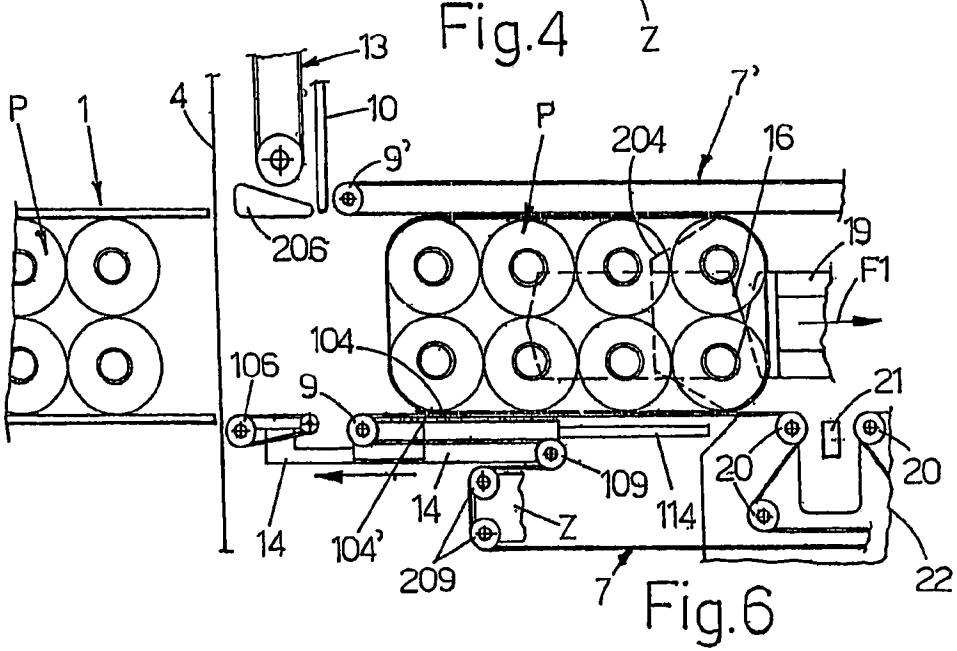
Figure 5:
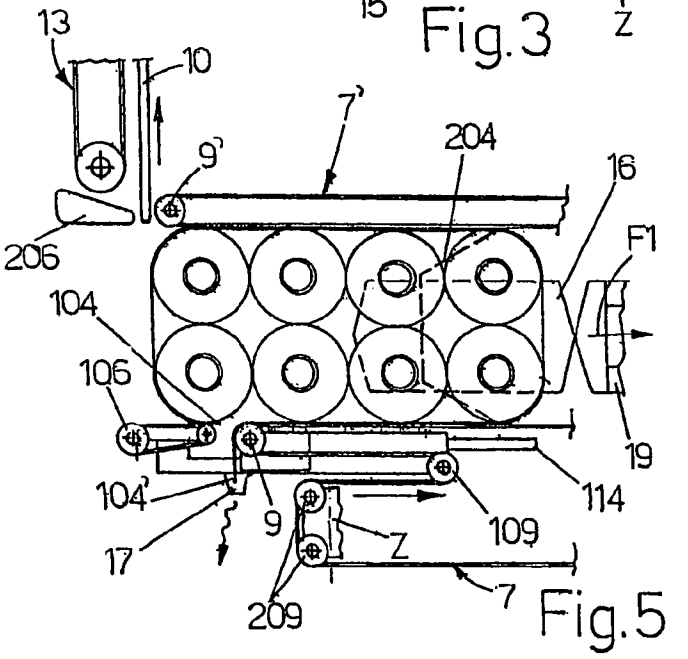

In the ensuing description, the construction and operation of the machine for packaging groups of rolls of hand towels paper are described in detail, without thereby ruling out the use of the same machine for packaging other individual products or groups of products. From FIGS. 1 and 2 it may be noted that the machine comprises a magazine 1, cyclically formed in which is a prismatic group with a rectangular base of rolls P of paper, set in one or more layers on top of one another, and said magazine is provided with a bottom wall 101 that remains fixed as the format of the group of products P varies and is provided with a top wall 201 that must instead be adjusted in height as said format varies. In FIG. 1, designated by F is a possible direction of feed of the rolls of paper, which, in the example referred to, have their hollow core oriented longitudinally in the direction in which they are fed by the action of the thrust cross members 102 of feed conveyors 2 of a known type. On the face opposite to the one concerned by the cross members 102, the magazine 1 is closed by a vertical containment wall 301, the position of which is adjusted as the format of the products P varies. Located on one side of the magazine 1 is a pusher 3 connected to translation means 103 (FIG. 1) set underneath the plate 101, which for this purpose has a slit 203 designed to be traversed by the appendage that connects said translation means 103 to the pusher 3 when this is activated for unloading the group of rolls P from the magazine 1 and for transferring it towards subsequent means; with a displacement F1 in a direction orthogonal to the direction F of feed of the group of rolls into the magazine itself. On the side of the magazine 1 opposite to the one engaged by the pusher 3 referred to previously, is set, crosswise and with a suitable vertical arrangement, the sheet 4 (FIG. 1) of the packaging material, which, in the example referred to, is made of heat-sealable plastic material and is withheld by the top flap and by the bottom side, by pairs of motor-driven parallel belts 5, 105, which form part of a supply assembly that derives the sheets 4 from a continuous film wound off a reel (this assembly not being illustrated herein in detail, in so far as it is known). On the same side of the magazine 1 that is engaged by the packaging sheet 4, alongside said sheet, is set the first folding spindle 6, which comprises a top horizontal wall 206 and a bottom horizontal wall or rather a bottom horizontal conveyor 106, which are coplanar, respectively, to the walls 101 and 201 of the magazine 1 set upstream and of which, like said walls, just the top wall 206 is height-adjustable as the format of the product P to be packaged varies. The bottom conveyor 106 is, for example, formed by a plurality of belts set parallel to one another, oriented in the direction of advance F1 of the product in the packaging step, appropriately set at a distance from one another and idle or appropriately motor-driven, as mentioned later on. On the face of the components 106 and 206 of the spindle 6, opposite to the one concerned by the packaging sheet 4, there operate, in co-planar alignment to said components, horizontal conveyors 7, 7', set on top of one another and actuated by a centralized motor-drive 8 that gets them to travel with the internal branches in the same direction and at the same speed as the active working travel of the pusher 3. Envisaged between the components 106 and 206 of the spindle 6 and the first guide rollers 9, 9' of the conveyors 7, 7' is a horizontal distance sufficient to enable displacement of a flat folder 10 set vertically and with an arrangement orthogonal to the direction F1 of advance of the product P, said folder being formed by a plate with a surface appropriately coated with material having a low coefficient of friction in regard to the sheet 4 and on which vertical belts, set at appropriate distances from one another, can be guided with purposely provided end rollers, which can be idle or appropriately motor-driven. The folder 10 is fixed on a carriage 11, which slides on vertical guide means 12 fixed to an appendage of the frame of the machine and can, upon command, be lowered and raised, with a travel of an amount correlated to the format of the product to be packaged, by the action of a rectilinear actuator 13. As the format of the product varies, means are provided to enable height-adjustment of the folder 10, together with the top plate 206 of the spindle 6, in so far as, at the start of each working cycle, the same folder 10 is set with its own bottom end slightly above said plate 206, as illustrated in FIG. 2. When, instead, the folder 10 is brought into its own active working travel, as illustrated in FIG. 4, it is brought with its own bottom stretch into the space between the conveyor 106 and the first return idler roller 9 of the conveyor 7. With a reverse travel of the actuator 13, the folder 10 is then raised and brought back into the position of start of cycle, as explained in greater detail hereinafter. From FIGS. 2 and 3 it may be noted that the bottom conveyor 106 of the first-folding spindle 6 is supported by a carriage 14 mounted on horizontal guide means 114 and actuated by means of horizontal displacement, which, upon command, first move it away from the spindle 6 and then bring it up to said spindle, as indicated schematically by the double-headed arrow 15, and mounted idle on said carriage 14 are both the first guiding idler roller 9 of the conveyor 7 and a second parallel roller 109, on which the same conveyor 7 is caused to describe a zigzag path, whilst the bottom roller or the further bottom rollers 209 of the same conveyor 7 are supported idle by the fixed frame Z of the machine. It follows that, when the carriage 14 is moved away from the folding spindle 6, the top branch of the conveyor 7 shortens, whilst, when the carriage 14 is brought back into the position of start of cycle, the top branch of the same conveyor 7 lengthens proportionally, and said conveyor always remains correctly tensioned on account of the presence of the compensation roller 109. The first parts of the machine, as described so far, function as explained in what follows. When grouping of the product P in the magazine 1 has taken place and positioning of a packaging sheet 4 in front of the spindle 6 has taken place also, a command is issued for the pusher 3 to perform the active working travel towards the right (as viewed in FIGS. 1 and 2), whilst the parallel conveyors 7, 7' are activated so as to move with their internal branches in the same direction and at the same speed of translation as said pusher 3. The packaging sheet 4 is in the meantime withheld with a limited friction by the conveyor belts 5, 105 so that, when the front face of the product P that advances touches said sheet 4 and this is forced through the components 106, 206 of the spindle 6, the sheet 4 itself leaves said clamps and follows the product whilst everything is held without any sliding by the conveyors 7, 7' set downstream. In these first steps, the product is wrapped by the sheet 4 on the entire bottom face, on the front face, and on the entire top face and with said sheet that projects from the front face with a stretch 104 of the right length, which, after abandonment by the top belt 5, can be kept distended by the action of purposely provided guide means (not illustrated) or by a jet of air. The sheet 4 has a width appropriately larger than that of the product P so as to project with right-sized stretches on both sides of the product itself, to enable formation of the closing flaps that will then be folded and fixed on the sides of the product itself, as mentioned later on. The travel of the pusher 3 stops when the entire product has passed beyond the spindle 6 and the first return idlers 9, 9' of the conveyors 7, 7', which at the right moment also stop, as illustrated in FIG. 3. FIG. 2*a* illustrates the product at the end of these first steps of the winding cycle, during which the first vertical-folding side flaps 204, in front of the front ones with respect to the direction of advance F1 of the product, are folded on the sides of the product itself by the action of folders 16, 16', for example of a static type, set alongside the conveyors 7, 7' (FIGS. 1, 2, 3). Whilst the pusher 3 returns into the position of start of cycle and a new group of products is formed in the magazine 1, according to FIG. 2, the vertical folder 10 is lowered (as illustrated in FIG. 4) so as to fold vertically downwards the stretch 104 of the wrapping sheet that completely wraps the rear face of the product and projects at the bottom from this by the right amount (as illustrated in FIG. 4*a*). Fixed with respect to the carriage 14 there can be provided a suction mouth 17, which is activated to keep the stretch of sheet 104 that projects through the gap existing between the conveyor 106 and the conveyor 7 appropriately distended downwards. In appropriate phase succession, whilst the folder 10 is raised into the resting position, as illustrated in FIG. 5, the carriage 14 is, at the right moment, moved away from the spindle 6 to make available to the conveyor 106 for it to be spread under the bottom face of the product the first projecting portion of the stretch 104 of the wrapping sheet, whilst a corresponding stretch 104' of the portion of sheet that first was spread under the product is abandoned by the conveyor 7, which shortens, and is pulled down by the action of the suction mouth 17 and/or by other suitable means. FIG. 5*a* illustrates the product during this step of the wrapping cycle. In appropriate phase succession, as illustrated in FIGS. 6 and 6*a*, the carriage 14 is brought back up to the spindle 6, to cause, whilst the stretch of sheet 104 folded under the product is being progressively abandoned by the conveyor 106, progressive spreading out under the same stretch 104 of the stretch 104' of sheet that had previously been pulled down and that is now progressively being raised up again by the conveyor 7, which lengthens into the condition of start of cycle, whilst the suction mouth 17 is at the right moment neutralized. At the right moment, upon return of the carriage 14 to a resting position, the conveyors 7, 7' are activated for displacing the packaged product in the direction F1, so that the flap 104 will rapidly come into contact with the flap 104' during raising. The flaps 104, 104' of the wrapping sheet set on top of one another, as illustrated in FIG. 6*a*, are in the right condition for being subjected to the subsequent mutual heat-sealing by the action of the means mentioned later on. Before passing on to the description of the subsequent operating means of the machine, the following considerations are made on the vertical folder 10 and on the conveyor 106. When these components are formed by parallel belts and set at appropriate distances from one another, said belts can be idle or can be motor-driven by purposely provided means, which can be readily devised by persons skilled in the art, for example with the use of toothed belts or fixed racks, so that said belts will be able to distend the sheet 4 in the folding step and will be able, instead, to move away without any interference with the sheet that has been laid out in the subsequent step of abandonment. The belts of the vertical folder 10 can be structured with a comb-like bottom conformation so as to enable them to be interspersed with the belts of the bottom conveyor 106, which are also arranged with a longitudinally grooved and open shape of the spaces that are present between them. This solution would enable the conveyor 106 to move into contact with the stretch of sheet 104 in the step illustrated in FIG. 5, when said stretch of sheet is still withheld by the folder 10 in the low position. When the stretch of sheet 104 is pushed against the product by the conveyor 106, the folder 10 can be, at the right moment, raised without any prejudice to the packaging being formed. From FIG. 1 it may be noted that set alongside the conveyors 7, 7', upstream of the static folders 16, 16', are mobile and curved folders 18, 18', of a known type, which, under the action of purposely provided means, are at the right moment made to oscillate on the respective vertical axes whilst the packaged product is displaced by the conveyors 7, 7' in the direction F1 so as to fold on the sides of the product itself the vertical-folding rear side flaps 204' of the laterally projecting stretches of the packaging sheet, as illustrated in FIG. 7. When the vertical-folding flaps 204, 204' exit from the static folders 16, 16', said flaps are withheld on the product by the action of purposely provided fixed guides 19, 19' and of other folders, which will be described hereinafter. From FIG. 2 it may be noted that the top branch of the conveyor 7, downstream of the folders 16, 16', is run over four parallel rollers 20 that enable a small transverse gap to be formed on said branch of the conveyor, in which gap it is possible to house a heat-sealing bar 21 upon which the bottom part of the product is stopped, with the flaps 104, 104' set on top of one another, which are heat-sealed by said bar, using as contrast the packaged product P itself. The rollers 20 and said bar 21 are mounted on a carriage 22 that can slide on horizontal guide means and is controlled by adjustment means that enable variation of the position of said bar 21 as the format of the products to be packaged varies. Also mounted on the same carriage 22 are rollers 23 for return and tensioning of the bottom branch of the conveyor 7. When the product P with the packaging 4 reaches a position corresponding to the bottom heat-sealing bar 21, the side, bottom and horizontal-folding flaps 304 of the packaging sheet already come to co-operate with static side folders 24, 24' of a known type, which start to raise them, so that said flaps will not interfere with said heat-sealing bar 21. When the conveyors 7, 7' are reactivated to move the packaged product away in the direction F1, said folders 24, 24' complete raising of the bottom horizontal-folding flaps 304 and in appropriate phase succession the top horizontal-folding flaps 304', or, vice versa, come to co-operate with static side folders 25, 25', which also fold said flaps on the sides of the product, superimposing them on the vertical-folding ones 204, 204', 304 referred to previously. Finally, from FIGS. 1 and 2 it may be noted that at output from the conveyors 7, 7' the packaged product is taken up by a bottom horizontal conveyor 26 and by a pair of vertical conveyors 27, 27' parallel to one another, which, with the branches in contact with the packaged product, all advance without sliding in the direction F1, the internal branches of said vertical conveyors being aided by the action of purposely provided heating means 28, 28' for carrying out heat-sealing together of said side flaps set on top of one another of the packaging sheet, so that, at output from the latter conveyors, the product is wrapped by a perfectly closed packaging. Whilst a product with the packaging is transferred towards the station for heat-sealing with the bar 21, a new product with the packaging sheet is transferred by the pusher 3 between the active conveyors 7, 7'. From FIG. 2 it may be noted that, as the format of the product varies, all the bottom parts on which the product itself rests remain fixed, whilst there are provided means for varying the position in height of all the parts that are to come into contact with the top part of the product itself, namely, the top wall 201 of the magazine 1, the top plate 206 of the spindle 6 with the nearby vertical folder 10, and the top conveyor 7'. From FIG. 1 it may be noted, instead, that, as the format of the product varies, all the parts aligned with the static folder 16 and with the mobile folder 18, namely, the side folders 24, 25 and the final vertical heat-sealing conveyor 27, 28, remain stationary in their operating position, whilst there are provided means for enabling all the opposite parts to be adjusted in position and adapted to the format, so that in said adjustment the rear wall 301 of the magazine 1, the folders 16', 18', 24', 25', and the final vertical heat-sealing conveyor 27', 28' will be involved.

It remains understood that the description refers to a preferred embodiment of the invention, to which numerous variations and modifications, above all of a constructional nature, can be made, without thereby departing from the principle underlying the invention, as set forth above and as illustrated herein and claimed in the annexed claims. The references appearing in brackets in the claims are purely indicative and in no way limit the sphere of protection of said claims.

The invention claimed is:

1. A method for packaging groups of products ordered in one or more layers comprising:

a) supplying a parallelepipedal group of products in a feed-and-guide magazine;

b) arranging a packaging sheet in front of said feed-and-guide magazine, said sheet being arranged vertically and parallel to a front face of the group of products to be packaged;

c) unloading, by a thrust exerted on a rear face of the group of products from said feed-and-guide magazine and consequently horizontally displacing the group of products and forcing the group of products against said packaging sheet, which at a preselected time is abandoned by a corresponding positioning means, and moved through a first folding spindle from which the group of products exits wrapped by the sheet, said sheet forming a U-shaped wrapping rotated through 90° and open at a back side, with the group of products enveloped by the sheet on an entire bottom face, on the front face, and on an entire top face and with said sheet projecting from the top face for a stretch having a length greater than a height of the rear face of the group of products, upon output from said spindle, a wrapped product will be held at the bottom face and at the top face and made to advance without any sliding by a pair of horizontal conveyors arranged one over another and synchronized;

d) arresting the group of products partially wrapped at a start of said pair of conveyors where in appropriate phase succession a last top flap of the sheet is spread out on the rear face of the group of products and, for a stretch, is brought to project underneath the group of products, after which the sheet is folded under the group of products while a corresponding end stretch of the sheet that wraps the bottom face of the group of products is first lowered and is then raised up again under the group of products, so as to be placed under a last end stretch of the sheet;

e) mutually fixing said bottom end stretches of the packaging sheet set one on top of another;

f) folding at a preselected time on the side faces of the group of products, laterally projecting stretches of the packaging sheet, with folding in vertical-folding flaps of the sheet, of first the front face with respect to a machine working direction and then the rear face, and subsequently folding horizontal-folding flaps; and g) mutually fixing the side flaps set one on top of another of the packaging sheet.

2. A machine for packaging groups of products ordered in one or more layers, comprising:

a magazine for formation and subsequent guided supply of a parallelepipedal group of products to be packaged;

means for supplying and positioning a heat-sealable packaging sheet in a position corresponding to said magazine, said sheet being set vertically and parallel to a front face of the group of products to be packaged and being withheld by said means for supplying and positioning at a top side and at a bottom side;

a pusher for unloading the group of products from said magazine and for pushing the group of products through and towards a subsequent means which comprise:

a first-folding spindle set downstream of the packaging sheet located vertically in front of the group of products to be packaged;

a pair of horizontal conveyors, arranged one on top of another and motor-driven in synchronism, set downstream of said first-folding spindle;

a vertical folder with corresponding actuation means, which operates in a space between the first folding spindle and said pair of horizontal conveyors;

means including both a bottom component of the first folding spindle and a bottom component of said conveyors, to superimpose on a bottom face of the group of products transverse end flaps of the packaging sheet;

means for fixing by heat-sealing bottom flaps arranged one on top of another of the packaging sheet;

folding means, which are mobile and/or static, for folding on side faces of the group of products laterally projecting stretches of the packaging sheet; and means for unloading a packaged product and for heat-sealing to one another side flaps set one on top of another.

3. The machine according to claim 2, wherein the first folding spindle comprises a top horizontal wall and a bottom horizontal wall or a bottom horizontal conveyor, which is oriented along a longitudinal axis thereof in a direction of advance of the group of products and is either idle or motor-driven.

4. The machine according to claim 3, wherein the bottom conveyor of the first-folding spindle is supported by a carriage mounted on horizontal guide means and actuated by displacement means, which, upon command, by displacing the bottom conveyor horizontally a sufficient amount to cause the bottom conveyor first to move away from said spindle and then to move up to said spindle, and mounted idle on said carriage is both a first guiding idler roller of said bottom conveyor and a second parallel roller, on which rollers said bottom conveyor is made to provide a zigzag path, while other bottom and end rollers of said conveyor are supported idle by a fixed frame of the machine, in such a way that, when the carriage is moved away from the folding spindle, a top branch of the conveyor shortens in order to let a stretch of an end portion of the packaging sheet that covers a bottom face of the group of products drop and in order to enable folding on said bottom face, by action of the conveyor of the folding spindle, of an excess stretch of the end portion of the sheet that wraps a rear face of the group of products, while, when said carriage is brought back into a position of a start of cycle, a top branch of the conveyor lengthens proportionally and the bottom conveyor of the folding spindle returns into the position of the start of cycle in order to bring about raising of said end of the sheet that was previously lowered and to set the bottom conveyor on top of said end of the sheet that remains in a raised position.

5. The machine according to claim 2, wherein said vertical folder includes a plate with a surface, which is coated with material having a low coefficient of friction in regard to the packaging sheet and onto which a vertical conveyor, either idle or motor-driven, can be guided by end rollers, said vertical folder being fixed on a carriage, which slides on vertical guide means fixed to an appendage of a frame of the machine and can, upon command, be lowered and raised to correlate to a format of the group of products to be packaged, by a rectilinear actuator, with adjustment so as to accommodate the groups of products as the format thereof varies, said folder having a height which at a start of each working cycle is set at a bottom end thereof slightly above the first-folding spindle while, when said folder is brought into active working travel, said folder moves with its own bottom stretch into a space between a bottom conveyor of the first folding spindle and a first guiding idler roller of the bottom conveyor that operates downstream of said spindle.

6. The machine according to claim 5, wherein the conveyor of the vertical folder includes a plurality of belts set parallel to one another, vertically, and appropriately spaced apart from one another, and a bottom end of the folder with said belts is structured with a comb-like conformation so that the belts are interspersed and interpenetrate with corresponding parallel belts of a bottom conveyor of the first-folding spindle, said belts being prearranged with a longitudinally grooved and open shape of spaces present therebetween to enable said conveyor to perform active travel for folding under the groups of products an end vertical stretch of the packaging sheet, when said stretch of the sheet is still withheld by the vertical folder in a low position, means being provided for subsequently raising said folder to enable said conveyor to complete an active working travel.

7. The machine according to claim 2, wherein a bottom conveyor of the first folding spindle is supported by a carriage mounted on horizontal guide means and actuated by displacement means, upon command, by displacing the bottom conveyor horizontally a sufficient amount to cause the bottom conveyor first to move away from said spindle and then to move up to said spindle, and mounted idle on said carriage is both a first guiding idler roller of said bottom conveyor and a second parallel roller, on which rollers said bottom conveyor is made to provide a zigzag path, while other bottom and end rollers of said conveyor are supported idle by a fixed frame of the machine, in such a way that, when the carriage is moved away from the folding spindle, a top branch of the conveyor shortens in order to let a stretch of an end portion of the packaging sheet that covers a bottom face of the group of products drop and, in order to enable folding on said bottom face, by action of the conveyor of the folding spindle, of an excess stretch of the end portion of the sheet that wraps a rear face of the group of products, while, when said carriage is brought back into a position of a start of cycle, a top branch of the conveyor lengthens proportionally and the bottom conveyor of the folding spindle returns into the position of the start of cycle in order to bring about raising of said end of the sheet that was previously lowered and to set the bottom conveyor on top of said end of the sheet that remains in a raised position.

8. The machine according to claim 7, further comprising means for causing the conveyors, while said carriage returns to the position of start of cycle, to be activated at a predetermined time to feed the group of products with the packaging sheet in a direction of packaging so as to facilitate correct superposition of bottom end flaps of said packaging sheet.

9. The machine according to claim 7, further comprising a suction bar fixed to said carriage and which promotes distension downwards of end stretches of the packaging sheet in steps in which said end stretches of the sheet are distended on bottoms of products set on top of one another.

10. The machine according to claim 2, wherein the means for fixing by heat-sealing said bottom flaps of the packaging sheet comprise a heat-sealing bar mounted on a carriage that can slide on horizontal guide means and is controlled by adjustment means that enable variation of an operating position of said bar to correspond to varying formats of the group of products.

11. The machine according to the claim 2, comprising means for causing, as format of the group of products varies, all bottom parts on which the group of products rests to remain fixed, while allowing variation in height of all parts that are to come into contact with a top part of a same group of products, including a top wall of the magazine, a top plate of the first folding spindle with the vertical folder, and a top conveyor that operates downstream of said spindle.

12. The machine according to claim 2, comprising means for causing, as format of the group of products varies, all parts aligned with a static folder and with a mobile folder, including side folders and final vertical heat-sealing conveyor, to remain stationary in an operating position, while all opposite parts are adjustable in position and adapted to the format, so that upon adjustment of a rear wall of the magazine, side folders, and the final vertical heat-sealing conveyor are involved.

* * * * *